US005615871A

United States Patent [19]

Kleinhen

[11] Patent Number: 5,615,871

[45] Date of Patent: Apr. 1, 1997

[54] SHEET MATERIAL HANDLING APPARATUS AND METHOD

[75] Inventor: Stephen R. Kleinhen, Eaton, Ohio

[73] Assignee: Heidelberg Finishing Systems, Inc., Dayton, Ohio

[21] Appl. No.: 592,009

[22] Filed: Jan. 26, 1996

[51] Int. Cl.[6] ..... B42C 1/00; B65H 39/00

[52] U.S. Cl. ..... 270/45; 270/52.16; 270/52.29

[58] Field of Search ..... 270/45, 51, 52.16, 270/52.26, 52.27, 52.28, 52.29

[56] References Cited

U.S. PATENT DOCUMENTS

| | | | |
|---|---|---|---|
| 2,251,943 | 8/1941 | Kleineberg . | |
| 3,650,525 | 3/1972 | Hageman et al. | 270/54 X |
| 4,706,950 | 11/1987 | Rvetschle et al. | 270/52.28 |
| 4,844,433 | 7/1989 | Hastie | 270/52.27 |
| 4,989,850 | 2/1991 | Weller | 270/52.27 X |
| 5,067,700 | 11/1991 | Dick | 270/52.29 |
| 5,100,118 | 3/1992 | Hobbs et al. | 270/53 |

*Primary Examiner*—Hoang Nguyen

*Attorney, Agent, or Firm*—Tarolli, Sundheim, Covell, Tummino & Szabo

[57] ABSTRACT

A sheet material handling apparatus includes a collator conveyor, a hopper, and a sheet material handling assembly. The sheet material handling assembly removes sheet material articles from the hopper, folds the sheet material articles, creases the sheet material articles, and deposits the sheet material articles on the conveyor. The sheet material handling assembly includes a rotatable drum having grippers which grip a sheet material article. A folder assembly forms a fold in a central portion of the sheet material article while the sheet material article is held by the grippers and the drum is rotated. A creaser assembly creases the fold during continued rotation of the drum. The gripper assembly is then operated to release the sheet material article for movement toward the conveyor. Thereafter, the creaser assembly releases the sheet material article and the sheet material article is deposited on the conveyor.

28 Claims, 5 Drawing Sheets

SHEET MATERIAL HANDLING APPARATUS AND METHOD

BACKGROUND OF THE INVENTION

The present invention relates to a new and improved sheet material handling apparatus and method and more specifically to a sheet material handling apparatus and method for use in folding and/or creasing sheet material articles.

A known sheet material handling apparatus includes a saddle-type collator conveyor having receiving locations which are sequentially moved past hoppers from which sheet material articles are fed. The sheet material articles are fed one at a time from each of the hoppers in turn onto the collator conveyor to form a group of signatures (sheet material articles) at each of the receiving locations on the saddle conveyor. A folded cover may be the last sheet material article deposited on a group of sheet material articles at a receiving location on the collator conveyor.

SUMMARY OF THE INVENTION

The present invention provides a new and improved apparatus and method for use in handling sheet material articles. Sheet material articles are transferred from a hopper to receiving locations on a conveyor. In accordance with one of the features of the present invention, a sheet material handling assembly is operable to remove sheet material articles from the hopper, fold and/or crease the sheet material articles, and deposit the sheet material articles on the conveyor.

The sheet material handling assembly may include a rotatable drum on which grippers are disposed. The grippers grip a sheet material article in the hopper and pull the sheet material article from the hopper as the drum is rotated. During continued rotation of the drum, a folder forms a fold in the sheet material article. A creaser assembly on the drum may then crease the fold.

Once the sheet material article has been folded and creased, the grippers are operated from a closed condition to an open condition to release the sheet material article for movement toward the conveyor. After the sheet material article has been released by the grippers, the sheet material article is released by the creaser assembly. An ejector assembly may advantageously be utilized to eject the sheet material article from the creaser assembly.

BRIEF DESCRIPTION OF THE DRAWINGS

The foregoing and other features of the present invention will become apparent to one skilled in the art to which the present invention relates upon consideration of the following description of the invention with reference to the accompanying drawings, wherein.

DESCRIPTION OF ONE SPECIFIC PREFERRED EMBODIMENT OF THE INVENTION

General Description

Figure 1:
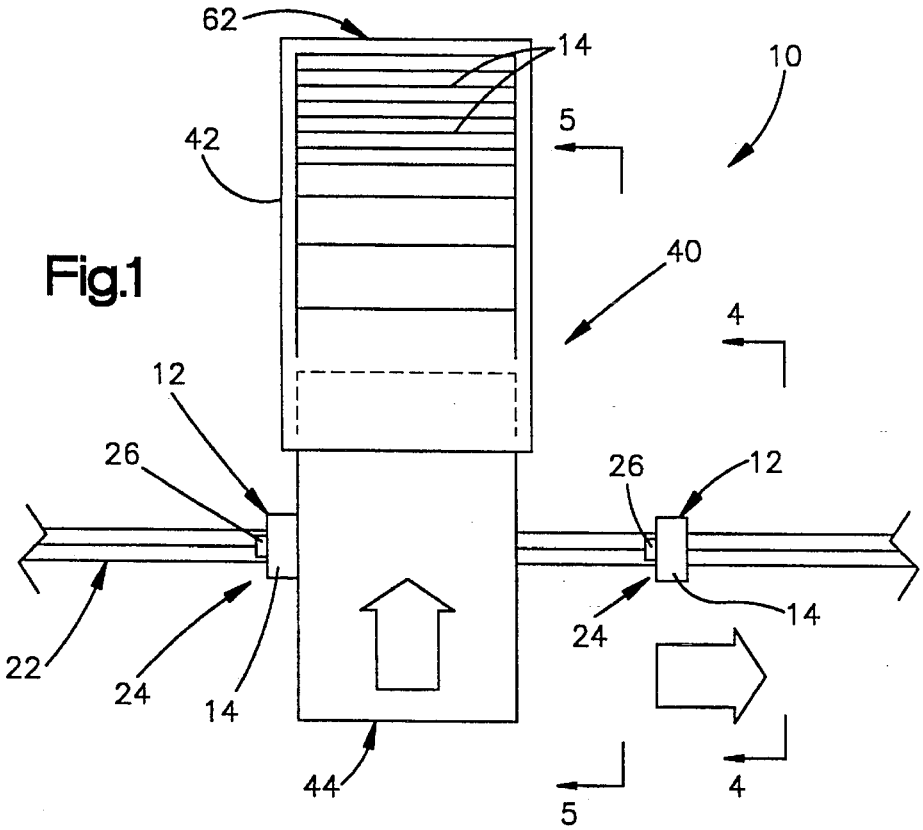
FIG. 1 is a fragmentary schematic illustration of a portion of a sheet material collator assembly.
Figure 4:
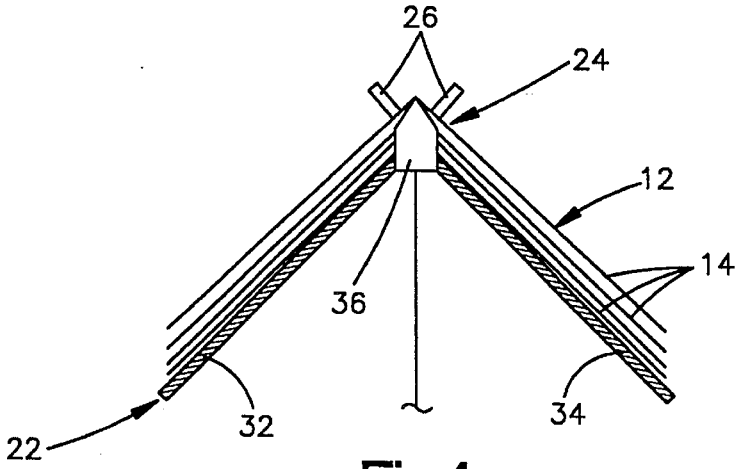
FIG. 4 is an enlarged fragmentary schematic illustration, taken generally along the line 4—4 of FIG. 1, illustrating a saddle-type collator conveyor which receives the folded and creased sheet material articles.

A sheet material collator assembly 10 (FIG. 1) sequentially forms collated assemblages 12 of sheet material articles. The sheet material collator assembly 10 includes a collator conveyor 22 (FIGS. 1 and 4). The collator conveyor 22 has a series of collating or sheet material article receiving locations 24 disposed between movable pusher elements 26.

The collator conveyor 22 (FIG. 4) is of the well known saddle type. The saddle-type collator conveyor 22 includes a pair of side sections 32 and 34 which support the sheet material articles 14. The sheet material articles 14 are moved, toward the right as viewed in FIG. 1, along the side sections 32 and 34 (FIG. 4) by a conveyor chain 36. A linear array of sheet material article supply hoppers and feed mechanisms (not shown) are disposed upstream, toward the left as viewed in FIG. 1, from the portion of the sheet material collator assembly 10 illustrated in FIG. 1.

Sheet material article feed mechanisms upstream from the portion of the sheet material collator assembly 10 illustrated in FIG. 1, are operable to sequentially feed folded sheet material articles 14 onto each of the sheet material article receiving locations 24 on the collator conveyor 22. A stitcher assembly (not shown) may be provided downstream from the portion of the sheet material collator assembly 10 illustrated in FIG. 1, to stitch or staple the collated assemblies 12 of sheet material articles. Each stitched collated assembly 12 of sheet material articles is then sequentially moved to a trimmer which trims the edge portions of the collated assembly of sheet material articles to desired dimensions. Although the collator conveyor 22 and associated apparatus could have many constructions, in one specific embodiment of the invention, the collator conveyor 22 and associated apparatus, with the exception of a collating station 40, was a Harris Graphics Pacesetter 850 (Trademark) which is commercially available from Harris Graphics Corporation, a division of AM International, of Dayton, Ohio.

The portion of the sheet material collator assembly 10 illustrated in FIG. 1 is the collating station 40 where unfolded sheet material articles, specifically, covers, are removed from a hopper 42, folded, creased, and deposited on the collator conveyor 22 by a sheet material handling assembly 44. The sheet material handling assembly 44 is constructed and operated in accordance with the present invention.

Figure 2:
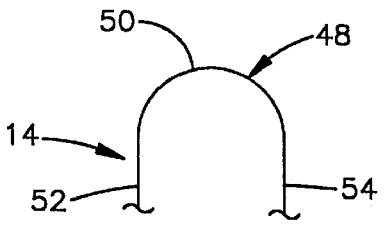
FIG. 2 is an enlarged schematic illustration depicting the manner in which a sheet material article is folded by a sheet material handling assembly in the collator assembly of FIG. 1.

The sheet material handling assembly 44 is operable to pull each of the covers or sheet material articles 14 in turn from the hopper 42. A fold 48 (FIG. 2) is then formed in the sheet material article 14. The fold 48 includes an arcuate bend portion 50 which interconnects opposite main sections 52 and 54 of the sheet material article 14.

Once the fold 48 has been formed in the sheet material article 14, a crease 58 (FIG. 3) is formed in the sheet material article 14. The crease 58 is formed by applying pressure against opposite sides of the fold 48 to form a sharp peak which interconnects the main sections 52 and 54 of the sheet material article 14o Since the sheet material article 14 is a cover, the creased and folded cover is the last article deposited on the collated assembly 12 of sheet material articles at sheet material receiving location 24 on the collator conveyor 22. Thus, as each collated assembly 12 of sheet material articles 14 is moved in turn past the final collating station 40 of the sheet material collator assembly 10 (FIG. 1), the sheet material handling assembly 44 is operable to deposit a folded and creased cover or sheet material article 14 onto the upper side of the collated assembly of sheet material articles.

Although it is preferred to use a saddle-type collator conveyor 22, it should be understood that other known types of collator conveyors could be utilized. It should also be understood that while it is preferred to use the sheet material handling assembly 44 to fold and crease covers, the sheet material handling assembly 44 could be utilized to remove sheet material articles other than covers from a hopper, fold, and crease the sheet material articles. In the illustrated embodiment of the invention, the sheet material handling assembly 44 first folds the sheet material article and then creases the sheet material article. However, it is contemplated that the sheet material handling assembly 44 could be used to fold a sheet material article without creasing the sheet material article or could be used to crease a prefolded sheet material article if desired.

Collating Station

The collating station 40 (FIG. 5) includes the hopper 42 which holds a stack 62 of unfolded sheet material articles 14 in an on-edge orientation. A suction applicator head 64 is disposed at the collating station 40 adjacent to a lower end portion of the hopper 42. The suction applicator head 64 is movable into engagement with a lower or leading edge portion 66 of each of the unfolded sheet material articles 14 in turn.

The suction applicator head 64 applies suction to the leading edge portion 66 of an unfolded sheet material article 14 to grip the sheet material article. The suction applicator head 64 then moves the leading edge portion 66 of the sheet material article 14 away from the stack 62 of unfolded sheet material articles. This results in the formation of a gap 68 between the leading edge portion 66 of the sheet material article 14 gripped by the suction applicator head 64 and the next adjacent sheet material in the stack 62 of sheet material articles.

The sheet material handling assembly 44 (FIG. 5) includes a movable structure 72. A drive mechanism 74 is connected with the movable structure 72 by a connection 76 illustrated schematically in FIG. 5. In the illustrated embodiment of the invention, the movable structure 72 is a rotatable drum. However, movable structures other than the drum 72 could be used if desired.

The drive mechanism 74 continuously rotates the drum 72 in a clockwise direction (as viewed in FIG. 5) about a horizontal central axis. The horizontal central axis of the drum 72 extends parallel to a longitudinal central axis of the collator conveyor 22. The horizontal central axis of the drum 72 also extends parallel to the leading edge portions 66 of the sheet material articles 14 in the stack 62 of sheet material articles. The rotatable drum 72 has a cylindrical configuration and is formed by a plurality of spaced apart interconnected circular disks.

Although it is preferred to feed unfolded sheet material articles 14 which are covers at the last collating station 40 along the collator conveyor 22, a different unfolded article could be fed at a different location along the collator conveyor. Thus, the sheet material handling assembly 44 could be used at any one of the collating stations along the conveyor 22 to feed any desired sheet material article.

Gripper Assemblies

A plurality of gripper assemblies 80, 82, and 84 are mounted on the drum 72 and are rotated with the drum 72 relative to the hopper 42. Each of the gripper assemblies 80, 82 and 84 includes a plurality of gripper members 88 which are connected with the drum 72 at pivot connections 90. A head end portion 92 on each of the movable gripper members 88 cooperates with a stationary gripper member or block 94 which is fixedly connected with the drum 72. A roller 96 on an end portion of the gripper member 88 opposite from the head end portion 92 engages a stationary gripper-ejector control cam 102.

Figure 5:
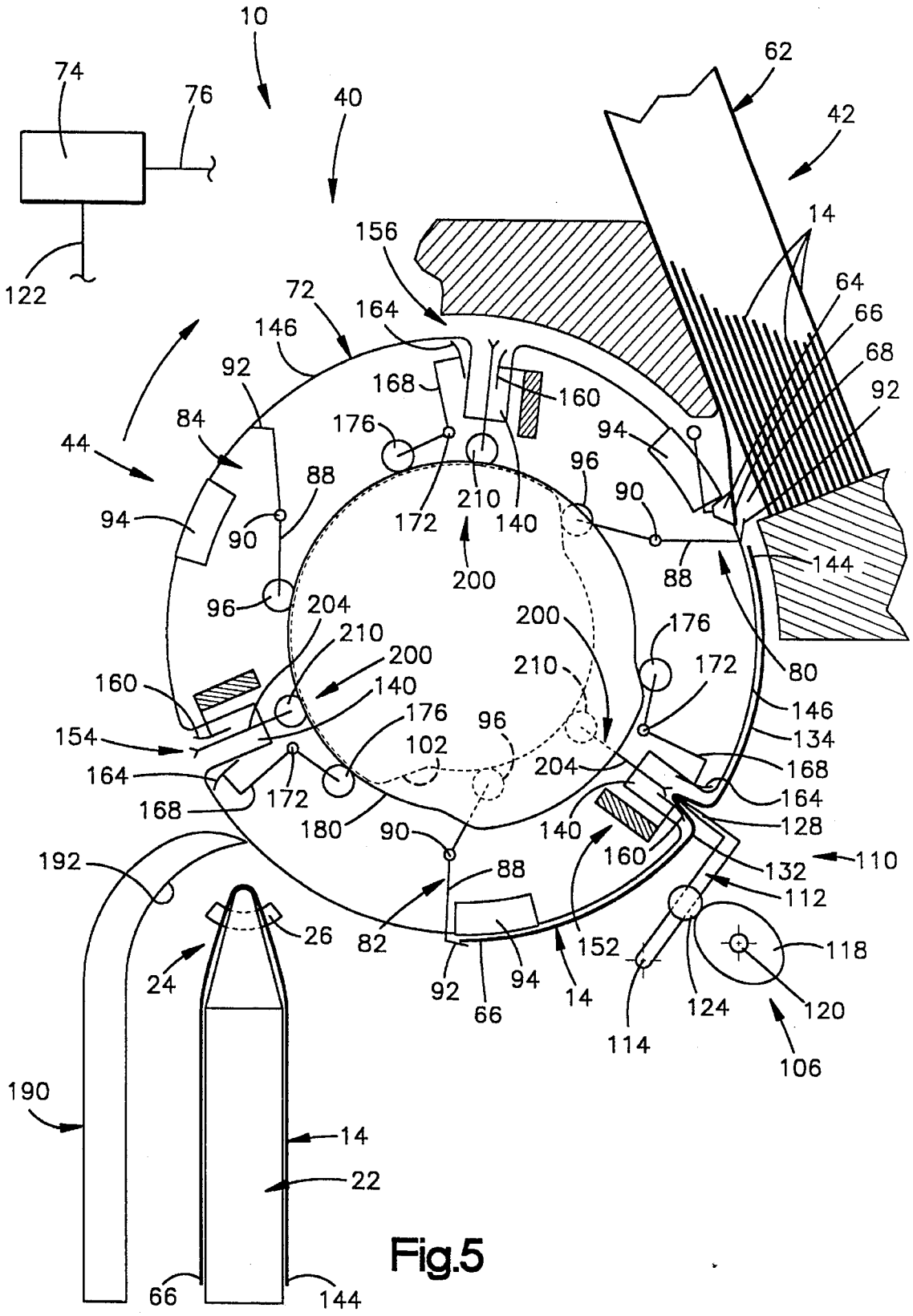
FIG. 5 is an enlarged schematic illustration, taken generally along the line 5—5 of FIG. 1, depicting the relationship between a hopper, the sheet material handling assembly, and the conveyor.
Figure 7:
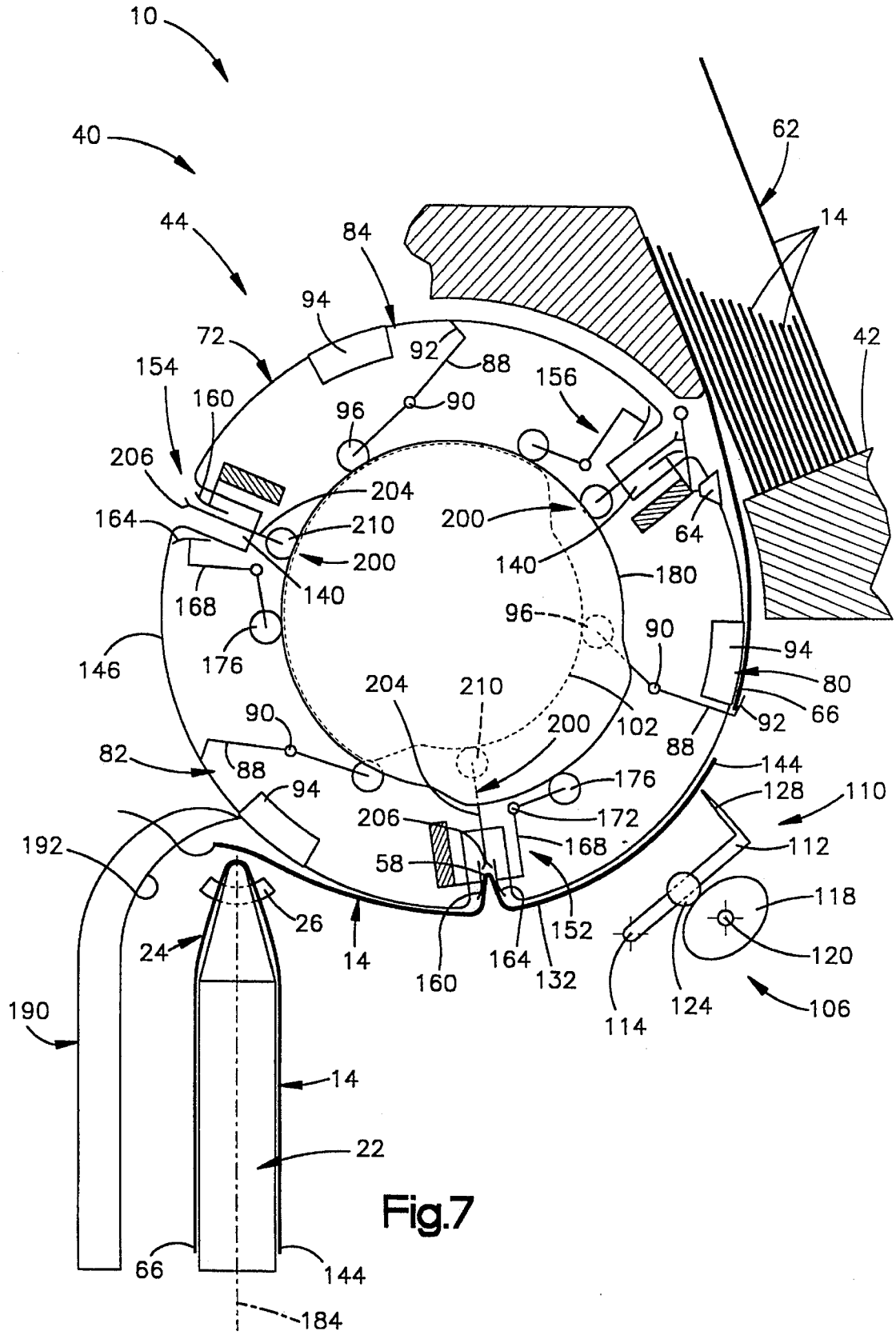
FIG. 7 is a simplified schematic illustration, generally similar to FIG. 5, depicting the manner in which a leading edge portion of a folded and creased sheet material article is released by grippers for movement toward the conveyor.

As the continuously rotating drum 72 moves through the position shown in FIG. 5, the stationary gripper-ejector control cam 102 is effective to operate the gripper assembly 80 from the open condition shown in FIG. 5 to the closed condition shown in FIG. 7. As the gripper assembly 80 is operated from the open condition to the closed condition, the head end portion 92 of the gripper member 88 enters the gap 68. As this occurs, the gripper member 88 pivots in a counterclockwise direction about the pivot connection 90 to securely clamp the leading edge portion 56 of the sheet material article 62 against the gripper or block 94.

Figure 8:
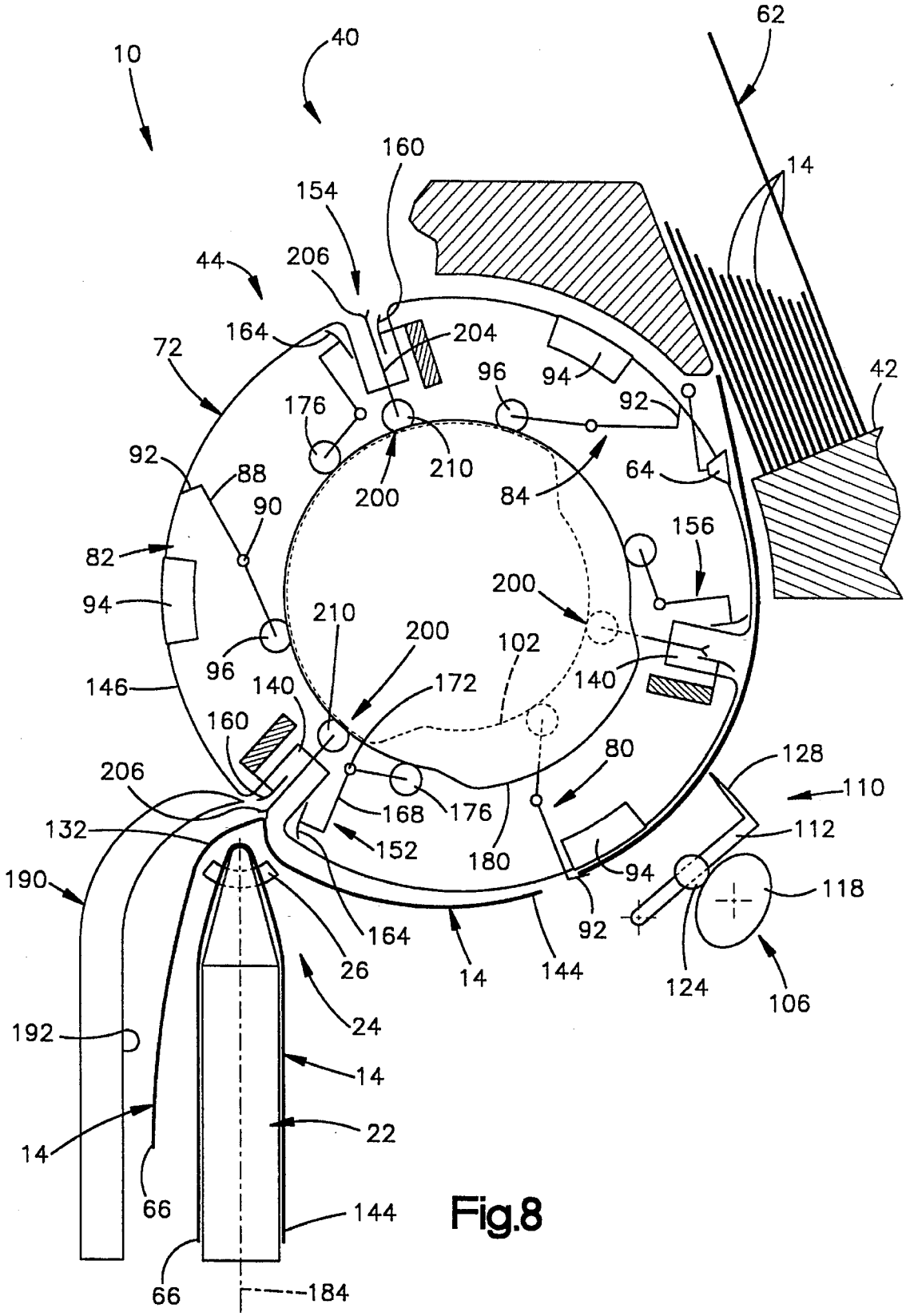
FIG. 8 is a simplified schematic illustration, generally similar to FIG. 7, depicting the manner in which a folded and creased portion of the sheet material article is ejected from the creaser assembly for movement toward the conveyor.

Continued rotation of the drum 72 in a clockwise direction (as viewed in FIG. 5) with the gripper assembly 80 in the closed condition results in the sheet material article 14 engaged by the gripper assembly 80 being pulled from the hopper 42 (FIGS. 7 and 8). The gripper member 88 is biased towards the closed condition of FIG. 7 by a suitable spring (not shown). After the leading edge portion 66 of the sheet material article 14 has moved adjacent to the conveyor 22, the gripper member 88 is moved from the closed condition to the open condition by the gripper-ejector control cam 102.

Although the gripper assembly 80 has been shown in FIG. 5 as having a single gripper member 88, the gripper assembly 80 includes a plurality of gripper members which are disposed at axially spaced apart locations along the length of the drum 72. It should be understood that the gripper assemblies 80, 82 and 84 all have the same construction and mode of operation.

Folder Assembly

A folder assembly 106 (FIG. 5) is disposed at a folding and creasing station 110 which is part of the collating station 40. The folder assembly 106 includes a movable folder blade or member 112. The folder blade or member 112 is pivotal about a pivot connection 114.

A folder control cam 118 is fixedly connected with a shaft 120 which is continuously rotated in a counterclockwise direction by the drive mechanism 74 through a drive train indicated schematically at 122 in FIG. 5. A rotatable cam follower 124 is mounted on the folder blade 112 and is disposed in engagement with the folder control cam 118. Therefore, rotation of the folder control cam 118 is effective to pivot the folder blade 112 toward the drum 72. The folder blade 112 is urged in a clockwise direction (as viewed in FIG. 5) about the pivot connection 114 by a suitable spring (not shown) to maintain the roller 124 in engagement with the folder control cam 118.

Figure 6:
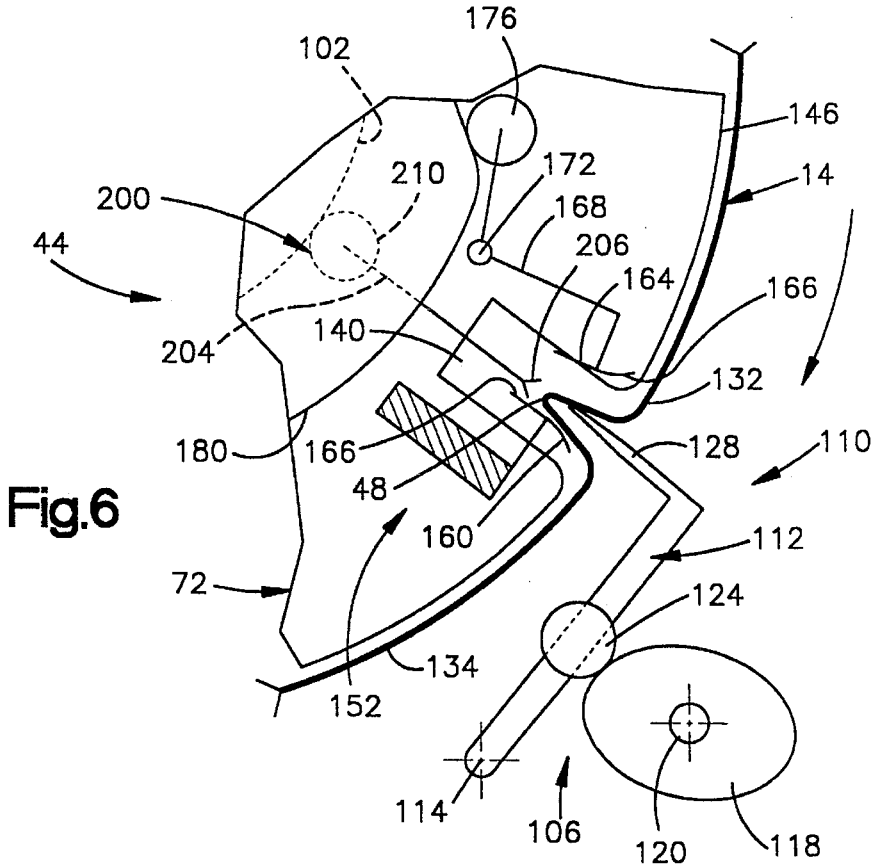
FIG. 6 is an enlarged simplified fragmentary schematic illustration of a portion of the apparatus of FIG. 5 and depicting the relationship between a folder member and a portion of a sheet material article.

The folder blade 112 (FIGS. 5 and 6) has a longitudinally extending nose end portion 128 which extends axially along the drum 72. The nose end portion 128 of the folder blade 112 has a length which is at least as great as the axial length of the drum 72. A longitudinal central axis of the nose end portion 128 of the folder blade 112 extends parallel to the central axis about which the drum 72 rotates. The longitudinal central axis of the nose end portion 128 of the folder blade 112 also extends parallel to the leading edge portion 66 (FIG. 5) of the sheet material articles 14. During operation of the folder assembly 106, a fold 48 (FIG. 6 is formed in a central portion 132 of a sheet material article 14.

During formation of the fold 48 in the sheet material article 14, force is transmitted from the rotating folder control cam 118 to the folder blade 112. This force presses the nose end portion 128 (FIG. 5) of the folder blade 112 against an outwardly facing major side surface 134 of the sheet material article 14 at the central portion 132 of the sheet material article. The force applied against the central portion 132 of the sheet material article by the nose end portion 128 of the folder blade 112 deflects the central portion of the sheet material article 14 into a longitudinally extending recess 140 formed in the rotatable drum 72. The recess 140 extends throughout the entire axial length of the drum 72 and has a longitudinal central axis which is parallel to the central axis about which the drum rotates.

As the central portion 132 of the sheet material article 14 is pressed into the recess 140, the fold 148 is formed. Since the leading edge portion 66 of the sheet material article 14 is gripped by the gripper assembly 82, a trailing edge portion 144 of the sheet material article 14 moves along a cylindrical peripheral side surface 146 of the rotating drum 72 toward the recess 140 as the fold 48 is formed.

Once the central portion 132 of the sheet material article 14 has been deflected into the recess 140 (FIG. 5) by the nose end portion 128 of the folder blade 112, the folder blade 112 pivots in a clockwise direction (FIG. 6) about the connection 114 and moves out of engagement with the folded sheet material article 14. The folded central portion 132 of the sheet material article 14 remains in the recess 140 as the folder member 112 is moved from the extended position of FIG. 5 back toward the retracted position of FIG. 7. The leading edge portion 66 of the sheet material article 14 is still firmly held by the gripper assembly 82.

Creaser Assembly

Figure 3:
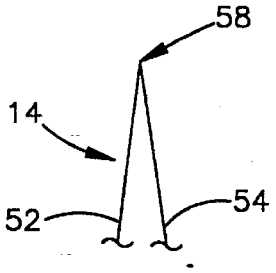
FIG. 3 is a schematic illustration, generally similar to FIG. 2, depicting in the manner in which the folded sheet material article is creased by the sheet material handling assembly in the collator assembly of FIG. 1.

Immediately after the fold 48 is formed in the central portion 132 of the sheet material article 14, the fold is creased. This results in the arcuate bend portion 50 of the fold 48 (FIG. 2) being deformed to form a sharp crease 58 (FIG. 3). To form creases 58 in each of the sheet material articles 14 in turn, a plurality of creaser assemblies 152, 154, and 156 (FIG. 5) are disposed on the drum 72.

Each of the creaser assemblies 152, 154, and 156 (FIG. 5) is mounted in association with a longitudinally extending recess 140 in the rotatable drum 72. Each of the creaser assemblies 152, 154 and 156 has a length which is at least as great as the axial extent of the drum 72. Each of the creaser assemblies 152, 154 and 156 has a longitudinal central axis which extends parallel to the central axis about which the drum 72 rotates.

The creaser assemblies 152, 154 and 156 are spaced equal distances apart about the periphery of the drum 72. Each of the creaser assemblies 152, 154 and 156 is disposed approximately midway between adjacent gripper assemblies 80, 82 and 84. However, each of the creaser assemblies 152, 154 and 156 is somewhat closer to a leading adjacent gripper assembly than to a trailing adjacent gripper assembly. Thus, the creaser assembly 152 is somewhat closer to the gripper assembly 82 than it is to the gripper assembly 80.

The creaser assembly 152 includes a longitudinally extending stationary creaser member 160 (FIG. 6) which is disposed adjacent to a leading side of the recess 140. The creaser assembly 152 also includes a longitudinally extending movable creaser member 164 which is disposed adjacent to a trailing side of the recess 140. The creaser members 160 and 164 have clamp surfaces 166 which are firmly pressed against opposite sides of a fold in the sheet material article 14.

The stationary creaser member 160 is fixedly connected with the drum 72 for rotation therewith. The movable creaser member 164 is mounted on a generally L-shaped creaser support member 168. The L-shaped creaser support member 168 is pivotally connected with the drum 72 at a pivot connection 172. A roller 176 is disposed on an inner end portion of the creaser support member 168 and engages a stationary creaser control cam 180 (FIG. 5). A suitable spring urges the creaser member 168 to pivot in a counterclockwise direction (as viewed in FIG. 5) to maintain the roller 178 in engagement with the stationary creaser control cam 180 as the drum 72 rotates relative to the creaser control cam.

After the folder assembly 106 is operated to form the fold 48 in the central portion 132 of the sheet material article 14, the creaser assembly 152 (FIG. 6) is operated to crease the fold. Thus, the creaser control cam 180 pivots the creaser support member 168 in a clockwise direction about the pivot connection 172. This moves the movable creaser member 164 toward the stationary creaser member 160. As this occurs, substantial pressure is applied against the main sections 52 and 54 (FIG. 2) of the folded sheet material article 14 to form the crease 58 (FIG. 3) in the sheet material article. Although only a single creaser support member 168 has been shown for each of the creaser assemblies 152, 154, 156, it should be understood that there are a plurality of creaser support members 168 supporting each of the movable creaser members 164.

During both folding and creasing of a sheet material article 14, the sheet material article is gripped by a gripper assembly. Thus, the leading edge portion 66 (FIG. 5) of the sheet material article 14 is gripped by the gripper assembly 82 as the folder assembly 106 forms the fold 48 in the central portion 132 of the sheet material article. The gripper assembly 82 continues to grip the leading edge portion 66 of the sheet material article 14 as the creaser assembly 152 forms a crease 58 in the central portion of the fold.

The crease 58 (FIG. 3) in the central portion of the fold is formed by firmly pressing the clamp surfaces 166 on the creaser members 160 and 162 (FIG. 6) against the main sections 52 and 54 (FIG. 3) of the sheet material article adjacent opposite sides of the fold 48. Once the crease 58 has been formed in the central portion 132 of the sheet material article 14, the central portion of the sheet material article is securely clamped between the stationary and movable creaser members 160 and 164 (FIG. 7). It should be understood that although the creaser members 160 and 164 have been shown in FIG. 7 as loosely gripping the sheet material article 14, the creaser members are actually being pressed firmly against the central portion of the sheet material article to tightly grip the sheet material article.

Transfer of Sheet Material Article to Conveyor

After the sheet material article 14 has been folded and creased in the manner previously described, the sheet material article is directly transferred to the collator conveyor 22. Thus, as the feed drum rotates from the position shown in FIG. 5, toward the position shown in FIG. 7, the gripper assembly 82 and the end portion 66 of the folded and creased sheet material article 14 move adjacent to the collator conveyor 22. As this occurs, the stationary gripper-ejector control cam 102 pivots the gripper member 88 in the gripper assembly 82 about the pivot connection 90. This moves the gripper member 88 from the closed condition of FIG. 5 to the open condition of FIG. 7.

The gripper assembly 82 is operated to the open condition as the leading edge portion 66 (FIG. 7) of the sheet material article 14 moves through a vertical plane 184 containing the horizontal longitudinal axis of the collator conveyor 22. As this occurs, the leading edge portion 66 of the sheet material article is released. However, at this time, the central portion 132 of the sheet material article 14 is firmly gripped by the creaser assembly 152. Thus, the central portion 132 of the sheet material article 14 is securely clamped between the creaser members 160 and 164 in the creaser assembly 152.

As the gripper assembly 82 is operated to the open condition, a leading edge guide or stripper member 190 (FIG. 7) is engaged by the leading edge portion 66 of the sheet material article 14. Continued rotation of the drum 72 moves the creaser assembly 152 and the gripped central portion 132 of the folded and creased sheet material article 14 toward the collator conveyor 22. As this occurs, the leading edge portion 66 is moved along an arcuate downwardly sloping inner side surface 192 of the leading edge guide 190. This results in the leading edge portion 66 of the sheet material article 14 being cammed downward toward the collator conveyor 22 as the drum 72 continues to rotate.

When the creaser assembly 152 has moved to a position closely adjacent to the collator conveyor 128, the creaser assembly 152 is operated from the closed condition of FIG. 7 to the open condition of FIG. 8. As this occurs, the creaser control cam 180 cooperates with the spring biased creaser support member 168 to pivot the creaser support member, under the influence of its biasing spring, about the pivot connection 172. This results in the movable creaser member 164 being moved away from the stationary creaser member 160 to release the central portion 132 of a sheet material article 14 for movement out of the recess 140 in the drum 72.

Ejector Assembly

At this time, an ejector assembly 200 is operated from a retracted condition (FIG. 7) to an extended condition (FIG. 8). As the ejector assembly 200 is operated to the extended condition, it applies force against the crease 58 in the central portion 132 of the sheet material article 14. This force positively moves the creased central portion 132 of the sheet material article 14 out of the recess 140 in the rotating drum 72. In addition, the force applied to the creased central portion 132 of the sheet material article 14 by the ejector assembly 200 accelerates the creased central portion of the sheet material article downward toward the collator conveyor 22. This results in the sheet material article 14 being transferred directly from the drum 72 to the conveyor 22 without passing through intermediate apparatus.

The ejector assembly 200 includes an ejector member 204 (FIG. 9) having a generally V-shaped end portion 206 which engages the crease 58 in the central portion 132 of the sheet material article 14. A roller 210 is rotatably mounted on an end portion of the ejector member 204 opposite from the V-shaped end portion 206. The roller 210 is disposed in engagement with the gripper-ejector control cam 102. A cylindrical sleeve (not shown) is fixedly connected with the drum 72 and guides movement of the ejector member 204 in a radial direction relative to the drum 72 under the influence of the gripper-ejector control cam 102.

As the ejector member 204 is moved radially outward relative to the drum 72 against the influence of a suitable biasing spring (not shown), the V-shaped end portion 206 of the ejector member 204 moves the central portion 132 of the sheet material article 14 out of the recess 140 toward the collator conveyor 22. This results in the folded and creased sheet material article 14 being deposited on the collator conveyor 22 on a collected assemblage of sheet material articles 14 at a receiving location 24 ahead of pusher elements 26.

The crease 58 in the central portion 132 of the sheet material article 14 is longitudinally aligned with folds formed in the sheet material articles 14 which were deposited on the collator conveyor 22 at collating stations ahead or upstream of the collating station 40 (FIG. 1). The longitudinal central axis of the crease 58 (FIG. 9) in the central portion of the sheet material article is parallel to the folds in the collated assemblage of sheet material articles already deposited on the collator conveyor 22 and is parallel to the horizontal longitudinal central axis of the collator conveyor. Since the collating station 40 (FIG. 1) is the last collating station along the collator conveyor 22, the folded and creased sheet material article 14 forms a cover for the collated assemblage of sheet material articles.

The sheet material handling assembly 44 (FIGS. 5, 7 and 8) transfers sheet material articles 14 from the hopper 42 to the collator conveyor 22. As the sheet material articles 14 are transferred by the sheet material handling assembly 44, the sheet material articles are folded and creased by the sheet material handling assembly. However, if desired, the sheet material handling assembly 44 could be constructed and operated so as to just fold the sheet material articles or just crease the sheet material articles.

Operation

During operation of the sheet material collating assembly 10 to form a collated assemblages 12 of sheet material articles, sheet material article receiving locations 24 disposed ahead of pusher elements 26 on the collator conveyor 22 (FIGS. 1 and 4) are sequentially moved past a series of collating stations in a known manner. At each of the collating stations, a sheet material article 14 is deposited on the collator conveyor 22 with a fold in the sheet material article disposed along a central portion of the collator conveyor. It is contemplated that the sheet material articles deposited on the collator conveyor 22 ahead of the collating station 40 may be prefolded sheet material articles which are opened and deposited on the collator conveyor in a known manner similar to that disclosed in U.S. Pat. No. 2,251,943 or U.S. Pat. No. 5,100,118.

At the collating station 40, unfolded sheet material articles 14 are folded, creased and deposited on a collated assemblage of sheet material articles at each of the receiving locations 24 in turn. The sheet material article 14 deposited on the collator conveyor 22 at the collating station 40 is the last sheet material article deposited on the collated assemblage of sheet material articles at a receiving location 24.

Therefore, the sheet material article 14 deposited at the collating station 40 forms the cover for the assemblage of sheet material articles.

When an unfolded sheet material article 14 is to be fed from the hopper 42 at the collating station 40 by the sheet material handling assembly 44, the leading or lower edge portion 66 of the sheet material article is engaged by the suction applicator head 64 (FIG. 5). The suction applicator head 64 is then moved away from the next adjacent sheet material article 14 in the stack 62 of sheet material articles to form a gap 68. As the continuously rotating drum 72 moves the open gripper assembly 80 adjacent to the hopper 42, the gripper assembly is operated from the open condition of FIG. 5 to the closed condition of FIG. 7. If desired, an apparatus similar to the apparatus disclosed in U.S. Pat. No. 3,650,525 could be used to form the gap 68.

The suction applicator head 64 then releases the leading edge portion 66 of the sheet material article. The leading edge portion 66 of the sheet material article is gripped by the gripper assembly 80 as the leading edge portion is released by the suction applicator head 64. Thus, the head end portion 92 of the movable gripper member 88 in the gripper assembly 80 presses the leading edge portion 66 of the sheet material article 14 against the stationary gripper member or block 94. This results in the leading edge portion 66 of the sheet material article being firmly gripped by the gripper assembly 80. Continued rotation of the drum 72 relative to the hopper 42 moves the closed gripper assembly 80 away from the hopper to pull the sheet material article from the hopper in the manner illustrated schematically in FIGS. 7 and 8.

As the gripper assembly 80 is moved adjacent to the hopper 42 to engage the leading edge portion 66 of a sheet material article 14, a central portion 132 of a next preceding sheet material article has been moved to the folding and creasing station 110 by the closed gripper assembly 82. At the folding and creasing station 110, the continuously rotating folder control cam 118 presses the nose end portion 128 of the folder blade 112 against the central portion of the sheet material article. The force applied against the outer side of the sheet material article 14 by the folder blade 112 presses the central portion 132 of the sheet material article into the recess 140 in the drum 72.

After the folder blade 112 has pressed the central portion 132 of the sheet material article 14 into the recess 140, continued rotation of the folder cam 118 results in the folder blade being moved away from the folded sheet material article (FIG. 6). As this occurs, the creaser assembly 152 is operated from the open condition of FIG. 5 through the intermediate condition of FIG. 6 to the closed condition of FIG. 7. As the creaser assembly 152 is operated, the roller 176 on the creaser member 168 moves along the stationary creaser cam 180.

As the creaser assembly 152 is closed, the fold 48 in the central portion 132 of the sheet material article 14 is clamped between the movable creaser member 164 and the stationary creaser member 160. As this occurs, the crease 58 (FIG. 3) is formed in the central portion 132 of the sheet material article 124.

During folding and creasing of the sheet material article 14, the gripper assembly 82 continuously grips the leading edge portion 66 of the sheet material article 14. After the creaser assembly 152 has been operated to the closed condition to form the crease 58 in the central portion 132 of the sheet material article, the sheet material article is gripped at two separate locations. Thus, the gripper assembly 82 continues to grip the leading edge portion 66 of the sheet material article while the creaser assembly 152 grips the central portion 132 of the sheet material article. This double gripping action of the sheet material article is maintained until the leading edge portion 66 of the sheet material article approaches the leading edge guide 190 in the manner shown schematically in FIG. 7.

As the leading edge portion 66 of the sheet material article 14 approaches the leading edge guide 190, the gripper assembly 82 is operated from the closed condition of FIG. 5 to the open condition of FIG. 7. As this occurs, the head end portion 92 on the gripper member 88 moves away from the stationary gripper member 94. This results in the leading edge portion 66 of the sheet material article 14 being released for movement away from the peripheral surface 146 of the drum 72.

Since the creaser assembly 152 is maintained in the closed condition, the central portion 132 of the sheet material article is firmly gripped by the creaser assembly. Therefore, continued rotation of the drum 72 results in the leading edge portion 66 of the folded and creased sheet material article 14 being pressed against the inner side surface 192 of the leading edge guide 190. The leading edge portion 66 of the sheet material article 14 is pressed against the guide 190 under the influence of force transferred from the rotating drum 72 to the sheet material article 14 through the creaser assembly 152. The inner side surface 192 of the leading edge guide 190 is effective to deflect the leading edge portion 66 of the sheet material article 14 downward (as viewed in FIG. 7) toward the collator conveyor 22. As this occurs, continued rotation of the drum 72 moves the creaser assembly 152 and the gripped central portion 132 of the sheet material article 14 toward the collator conveyor 22.

As the creaser assembly 152 approaches the collator conveyor 22, the creaser assembly 152 is operated from the closed condition of FIG. 7 to the open condition of FIG. 8 as a result of cooperation between the roller 176 on the creaser member 168 and the stationary creaser control cam 180. As the creaser assembly 152 is operated to the open condition to release the central portion 132 of the sheet material article 14, the ejector assembly 200 is operated from the retracted condition of FIG. 7 to the extended condition of FIGS. 8 and 9.

Figure 9:
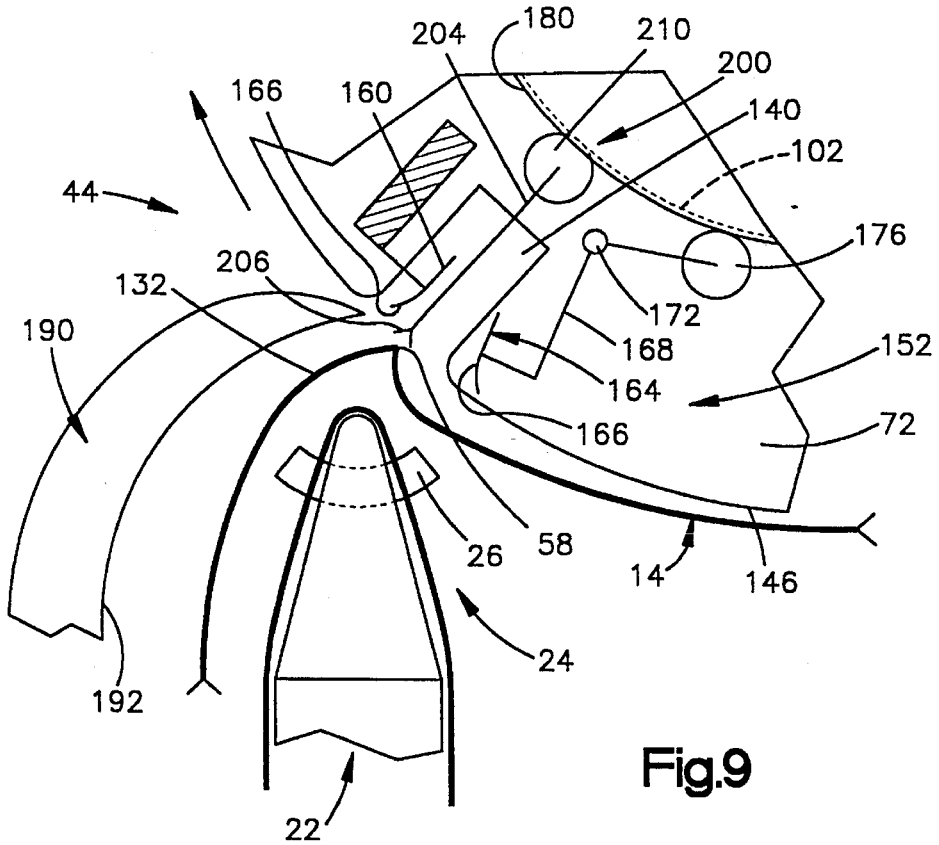
FIG. 9 (on sheet 3 of the drawings) is an enlarged simplified fragmentary schematic illustration of a portion of the apparatus of FIG. 8 further depicting the manner in which the folded and creased portion of the sheet material article is ejected from the creaser assembly.

As the ejector assembly 200 is operated to the extended condition of FIG. 9, the creased central portion 132 of the sheet material article 14 is pushed out of the recess 140 in the drum 72 by the ejector member 204. This results in the creased central portion 132 of the sheet material article 14 being thrust downward (as viewed in FIG. 8) toward the collator conveyor 22. The creased sheet material article 14 is deposited on the collator conveyor 22 with a longitudinal central axis of the crease 58 extending parallel to the longitudinal central axis of the collator conveyor.

As the drum 72 continues to rotate, the ejector assembly 200 is operated from the extended condition back to the retracted condition by the creaser control cam 180. As this is occurring, the next succeeding gripper assembly 84 is moved adjacent to the hopper 42 to engage the leading edge portion 66 of the next succeeding sheet material article 14. The foregoing process is repeated with three sheet material articles 14 being fed from the hopper 42 with each revolution of the drum 72. Of course, a greater or lesser number of gripper assemblies and creaser assemblies could be provided in association with the drum 72 to feed a greater or lesser number of sheet material articles 14 from the hopper 42 with each revolution of the drum 72.

Conclusion

In view of the foregoing description, it is apparent that the present invention provides a new and improved apparatus 10 and method for use in handling sheet material articles 14. Sheet material articles 14 are transferred from a hopper to receiving locations 24 on a conveyor 22. In accordance with one of the features of the present invention, a sheet material handling assembly 44 is operable to remove sheet material articles 14 from the hopper 42, fold and/or crease the sheet material articles, and deposit the sheet material articles on the conveyor 22.

The sheet material handling assembly 44 may include a rotatable drum 72 on which gripper assemblies 80, 82 and 84 are disposed. The gripper assembly 80, 82 or 84 grips a sheet material article 14 in the hopper 42 and pulls the sheet material article from the hopper as the drum 72 is rotated. During continued rotation of the drum 72, a folder assembly 106 forms a fold 48 in the sheet material article 14. A creaser assembly 152, 154 or 156 on the drum 72 may then crease the fold 48.

Once the sheet material article 14 has been folded and creased, the gripper assembly 80, 84 or 84 is operated from a closed condition to an open condition to release the sheet material article 14 for movement toward the conveyor 22. After the sheet material article 14 has been released by the gripper assembly 80, 82 or 84, the sheet material article is released by the creaser assembly 152, 154 or 156. An ejector assembly 200 may advantageously by utilized to eject the sheet material article 14 from the creaser assembly 152, 154 or 156.

Having described the invention, the following is claimed:

1. An apparatus for use in handling sheet material articles, said apparatus comprising a conveyor which is operable to convey sheet material articles, a hopper which holds a plurality of sheet material articles, and sheet transfer means for sequentially transferring sheet material articles from said hopper to said conveyor, said sheet transfer means including a rotatable drum, gripper means disposed on said drum for gripping an edge portion of a sheet material article as said drum is rotated, and creaser means disposed on said drum for forming a crease in a sheet material article as said drum is rotated and the edge portion of the sheet material article is gripped by said gripper means.

2. An apparatus as set forth in claim 1 wherein said creaser means includes first and second clamp surfaces disposed on said drum and means for pressing said first and second clamp surfaces against a sheet material article adjacent opposite sides of a location where a crease is to be formed in the sheet material article, said first and second clamp surfaces having longitudinal axes which extend parallel to an axis of rotation of said drum.

3. An apparatus as set forth in claim 2 further including ejector means disposed on said drum for ejecting the sheet material article from between said first and second clamp surfaces after a crease has been formed in the sheet material article.

4. An apparatus as set forth in claim 1 wherein said gripper means is operated from an open condition to a closed condition to grip the edge portion of the sheet material article while a portion of the sheet material article is disposed in said hopper, said gripper means being moved away from said hopper by rotation of said drum to pull a portion of the sheet material article gripped by said gripper means from said hopper.

5. An apparatus as set forth in claim 4 wherein said creaser means is operated from an open condition to a closed condition to form a crease in a portion of the sheet material article by gripping the sheet material article while said gripper means is in the closed condition gripping the edge portion of the sheet material article.

6. An apparatus as set forth in claim 5 wherein said gripper means is operated from the closed condition to the open condition to release the edge portion of the sheet material article for movement toward said conveyor while said creaser means is in the closed condition gripping the sheet material article and while said drum is being rotated to move the sheet material article toward said conveyor.

7. An apparatus as set forth in claim 1 further including a folder member movable from a retracted position to an extended position to form a fold in a central portion of the sheet material article and to move the central portion of the sheet material article into said creaser means as said drum is rotated and the edge portion of the sheet material article is gripped by said gripper means.

8. An apparatus as set forth in claim 7 wherein said folder member has a longitudinally extending edge portion which extends parallel to an axis about which said drum is rotated, said edge portion of said folder member being engageable with the central portion of the sheet material article to press the central portion of the sheet material article into said creaser means as said folder member is moved from the retracted position to the extended position as said drum is rotated and the edge portion of the sheet material article is gripped by said gripper means.

9. An apparatus as set forth in claim 7 wherein said creaser means is operable from an open condition to a closed condition to apply pressure against opposite sides of a bend formed in the central portion of the sheet material article by said folder member as said folder member moves the central portion of the sheet material article into said creaser means.

10. An apparatus as set forth in claim 1 wherein said gripper means is moved away from said hopper by said drum to pull a portion of the sheet material article from said hopper, said creaser means being operable to grip a central portion of the sheet material article and form a crease in the central portion of the sheet material article as said drum is rotated and the edge portion of the sheet material article is gripped by said gripper means, said drum being rotatable to move said gripper means and the edge portion of sheet material article from a first side of a plane containing at least a portion of a longitudinal central axis of said conveyor to a second side of the plane, said gripper means being operable to release the edge portion of the sheet material article to enable the edge portion of the sheet material article to move toward said conveyor while the central portion of the sheet material article is being gripped by said creaser means and is disposed on the first side of the plane, said creaser means being operable to release the central portion of the sheet material article to enable the central portion of the sheet material article to move onto said conveyor while the edge portion of the sheet material article previously gripped by said gripper means is on the second side of the plane and an edge portion of the sheet material article opposite from the edge portion of the sheet material article previously gripped by said gripper means is on the first side of the plane.

11. An apparatus for use in handling sheet material articles, said apparatus comprising hopper means for holding a stack of sheet material articles, gripper means for gripping an edge portion of a sheet material article and moving the gripped edge portion of the sheet material article away from the stack of sheet material articles to pull the sheet material article from the stack of sheet material articles, and folder means for forming a fold in the sheet material article while said gripper means is gripping the edge portion of the sheet material article and is moving the gripped edge portion of the sheet material article away from the stack of sheet material articles.

12. An apparatus as set forth in claim 11 further including creaser means for creasing the fold in the sheet material article while said gripper means is gripping the leading edge portion of the sheet material article and is moving the gripped edge portion of the sheet material article away from the stack of sheet material articles.

13. An apparatus as set forth in claim 11 further including a movable structure, means for moving said structure relative to the stack of sheet material articles, said gripper means being disposed on said structure and being movable with said structure in a direction away from the stack of sheet material articles to pull the sheet material article gripped by said gripper means away from the stack of sheet material articles, said folder means including surface means disposed on said structure and at least partially defining a longitudinally extending recess having a longitudinal axis which extends parallel to the edge portion of the sheet material article gripped by said gripper means, said folder means further including a blade member which is movable into the recess on said structure to at least partially form a fold in the sheet material article gripped by said gripper means as said structure and gripper means are moved relative to the stack of sheet material articles.

14. An apparatus for use in handling sheet material articles, said apparatus comprising a conveyor which is operable to convey sheet material articles, a hopper which holds a plurality of sheet material articles, a drum disposed adjacent to said hopper, a gripper disposed on said drum and operable from an open condition to a closed condition to grip a first edge portion of a sheet material article while a second edge portion of the sheet material article is in said hopper, said drum being rotatable to move said gripper and the first edge portion of the sheet material article away from said hopper to pull the second edge portion of the sheet material article from said hopper, and a folder member movable between a retracted condition and an extended condition in which said folder member extends into a recess on said drum to press a portion of the sheet material article into the recess and at least partially form a fold which is disposed midway between the first and second edge portions of the sheet material article as said drum is rotated and the first edge portion of the sheet material article is gripped by said gripper, said gripper being operable from the closed condition to the open condition to release the first edge portion of the sheet material article for movement toward said conveyor.

15. An apparatus as set forth in claim 14 further including creaser means disposed on said drum for forming a crease in the portion of the sheet material article pressed into the recess by said folder blade.

16. An apparatus as set forth in claim 14 wherein said conveyor is operable to move the sheet material article away from said drum with a central axis of the fold extending parallel to a longitudinal central axis of said conveyor.

17. A method comprising the steps of rotating a drum relative to a hopper containing a stack of sheet material articles, gripping an edge portion of a sheet material article which is at least partially disposed in the hopper with a gripper disposed on the rotating drum, thereafter, pulling at least a portion of the sheet material article from the hopper by continuing to rotate the drum to move the gripper away from the hopper, and at least partially forming a fold in the sheet material article while continuing to rotate the drum and while gripping the sheet material article with the gripper.

18. A method as set forth in claim 17 further including the step of transferring the folded sheet material article directly from the rotating drum onto a conveyor with the fold disposed along a longitudinal axis of the conveyor and with portions of the sheet material article disposed on opposite sides of the fold disposed on opposite sides of a vertical plane extending through the longitudinal axis of the conveyor.

19. A method as set forth in claim 17 wherein said step of forming a fold in the sheet material article includes pressing a folder member against the central portion of the sheet material article and moving a portion of a central portion of the sheet material article into a recess on the rotating drum under the influence of force applied against the sheet material article by the folder member.

20. A method as set forth in claim 17 further including the step of creasing the fold in the sheet material article while continuing to rotate the drum and while gripping the sheet material article with the gripper.

21. A method as set forth in claim 20 wherein said step of creasing the fold in the sheet material article includes gripping opposite sides of the fold with a pair of surfaces on the drum.

22. A method comprising the steps of rotating a drum relative to a hopper containing a stack of sheet material articles, gripping an edge portion of a sheet material article which is at least partially disposed in the hopper with a gripper which is disposed on the rotating drum, thereafter, pulling at least a portion of the sheet material article from the hopper by continuing to rotate the drum to move the gripper away from the hopper, and forming a crease in the sheet material article while continuing to rotate the drum and while gripping the sheet material article with the gripper.

23. A method as set forth in claim 22 further including the step of transferring the creased sheet material article directly from the rotating drum onto a conveyor in an orientation in which the crease is disposed along a longitudinal axis of the conveyor and portions of the sheet material article disposed on opposite sides of the crease are disposed on opposite sides of a vertical plane extending through the longitudinal axis of the conveyor.

24. A method as set forth in claim 22 wherein said step of forming a crease in the sheet material article includes pressing first and second creaser surfaces on the drum against opposite sides of a location where a crease is to be formed in the sheet material article.

25. A method as set forth in claim 24 further including the step of releasing the edge portion of the article from the gripper on the drum while continuing to press the first and second creaser surfaces on the drum against the sheet material article.

26. A method comprising the steps of gripping a first edge portion of a sheet material article with gripper, pulling a second edge portion of the sheet material article from a hopper by moving the gripper away from the hopper while gripping the first edge portion of the sheet material article, applying force against a portion of a major side surface of the sheet material article to deflect a portion of the sheet material article disposed between the first and second edge portions of the sheet material article into a longitudinally extending recess which is being moved away from the hopper with the gripper, thereafter, releasing the first edge portion of the sheet material article from the gripper, moving the sheet material article out of the recess, and depositing the sheet material article onto a conveyor with the portion of the sheet material article which was deflected into the recess disposed in engagement with a central portion of the conveyor.

27. A method as set forth in claim 26 wherein said step of moving the sheet material article out of the recess is performed after releasing the first edge portion of the sheet material article from the gripper.

28. A method as set forth in claim 26 wherein said step of moving the sheet material article out of the recess includes applying force against the portion of the sheet material article disposed in the recess.

* * * * *